United States Patent [19]

Claassen

[11] 4,155,538

[45] May 22, 1979

[54] DEVICE FOR LOWERING A LOAD, FOR EXAMPLE A DIVING BELL FROM A VESSEL FROM A SPOT ABOVE THE WATER LEVEL TO A SPOT BENEATH THE WATER LEVEL

[75] Inventor: Josephus A. M. Claassen, Nuenen, Netherlands

[73] Assignee: Hydraudyne B.V., Boxtel, Netherlands

[21] Appl. No.: 891,926

[22] Filed: Mar. 30, 1978

[30] Foreign Application Priority Data

May 9, 1977 [NL] Netherlands ..... 7705103

[51] Int. Cl.[2] ..... B66D 1/48

[52] U.S. Cl. ..... 254/172; 212/3 R

[58] Field of Search ..... 254/172, 189, 173 R; 212/3 R, 3 A; 214/12, 14; 92/134, 137, 63, 62

[56] References Cited

U.S. PATENT DOCUMENTS

| | | | |
|---|---|---|---|
| 3,311,351 | 3/1967 | Blakely | 254/189 |
| 3,343,810 | 9/1967 | Parnell | 254/189 |
| 3,804,183 | 4/1974 | Duncan et al. | 254/172 |
| 3,871,527 | 3/1975 | Schimmeyer et al. | 254/189 |

FOREIGN PATENT DOCUMENTS

| | | | |
|---|---|---|---|
| 77872 | 7/1954 | Denmark | 254/189 |

*Primary Examiner*—Robert J. Spar
*Assistant Examiner*—Kenneth W. Noland
*Attorney, Agent, or Firm*—John P. Snyder

[57] ABSTRACT

A device for lowering a load for example a diving bell from a vessel from a spot above the water line to a spot beneath the water line, comprising a winch and a cable connected with the load and moved by said winch along at least one cable pulley rotatable about a shaft. In order to prevent that the cable becomes alternately slack and taut during contact of the load with the water, it is proposed to constantly maintain the taut state of the cable by placing the shaft of the pulley parallel to itself and connecting it with the plunger rod of a plunger cylinder provided with an accumulator.

13 Claims, 1 Drawing Figure

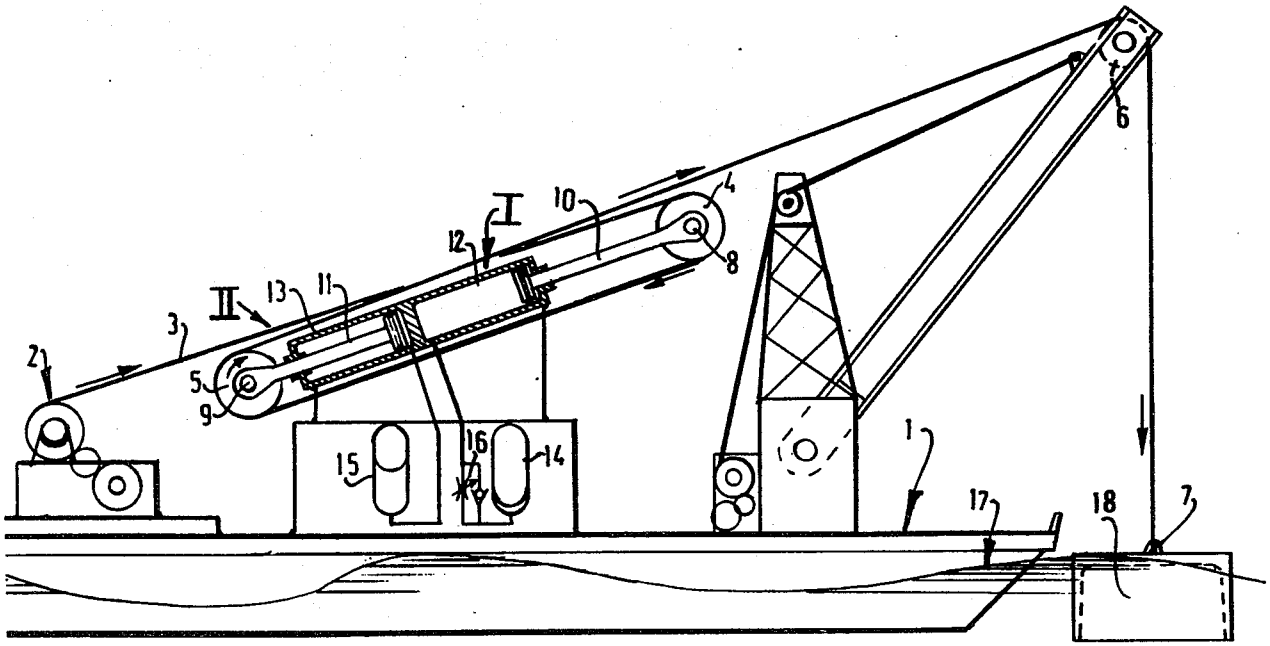
1
2
3
4
5
6
7
8
9
10
11
12
13
14
15
16
17
18
I
II

DEVICE FOR LOWERING A LOAD, FOR EXAMPLE A DIVING BELL FROM A VESSEL FROM A SPOT ABOVE THE WATER LEVEL TO A SPOT BENEATH THE WATER LEVEL

BACKGROUND OF THE INVENTION

The invention relates to a device for lowering a load, for example, a diving bell from a vessel from a spot above the water line to a spot beneath the water line, said device comprising a winch and a cable connected with the load and moved by said winch along at least one cable pulley rotatable about a shaft. When the load comes into contact with the water, the problem occurs that due to heaving of the vessel the cable becomes alternately slack and taut. It may, therefore, occur, that when the cable is slack the load is solely subjected to the wash of the waves and to other movements of the water so that the load may perform unpredictable motions. Especially in the case of a diving bell this is very troublesome, since the persons therein are exposed to strong, very disagreeable movements, for example, when the diving bell tilts. Particularly in the case of a rough sea this problem is serious. The solution of this problem is rendered difficult, since the force exerted by the load on the cable gradually decreases after traversing the water line due to the upward pressure exerted on the load by the water. In the case of non-solid objects, for example, a diving bell, this change is appreciable. When the load is fully immersed, the problem is simplified to an extent such that only the heaving of the vessel has to be taken into account.

SUMMARY OF THE INVENTION

The invention has for its object to provide a solution for the abovementioned problems. It tends to provide a device which constantly maintains the taut state of the cable both in passing across the water line and in full immersion of the load. According to the invention this is achieved in that the shaft of the pulley is displaceable parallel to itself and is connected with the plunger rod of a plunger cylinder provided with an accumulator. When the cable tends to slacken due to heaving of the ship, the force exerted by the load on the shaft of the pulley is reduced. This results in that the plunger can perform such a shift in place that by the simultaneous displacement of the shaft of the cable pulley the cable remains stretched.

An optimum control is obtained by providing two cable discs, the shaft of each of which is coupled with the plunger rod of a plunger cylinder, whilst the pressure in the accumulator of one of them is chosen so that the plunger is in one terminal position when the load is completely above the water line and in the other terminal position when the load is fully beneath the water line.

In this way an optimum control can be obtained for the situation in which the load is only partly below the water line. When the load has completely disappeared below the water line, compensation of heaving is obtained with the aid of the second plunger cylinder. To this end the pressure in the accumulator of the second plunger cylinder is chosen so that with the force exerted on the shaft of the associated cable disc when the load is fully immersed the plunger is standing substantially midway between the two terminal positions. The plunger cylinders are preferably filled with a hydraulic fluid and the accumulators are preferably of a hydro-pneumatic type. When the load strikes the water line during lowering, the force exerted on the cable will decrease and the plunger will slide out. In the event of an upward movement of the vessel due to heaving exceeding the downward movement of the load, the force exerted by the load on the cable will increase, as a result of which the plunger slides inwards. In order to avoid the risk of the plunger striking the bottom of the cylinder with heavy force, which would result in a jerk on the cable, the first plunger cylinder communicates trhough a conduit with the accumulator, said conduit being provided with a valve which blocks the conduit when the plunger reaches one terminal position. It is thus ensured that the pressure in the cylinder is gradually built up.

BRIEF DESCRIPTION OF THE DRAWING

The FIGURE shows the slack take-up means mounted on a vessel.

DESCRIPTION OF THE PREFERRED EMBODIMENT

On the ship is installed a winch 2, which drives a cable 3. The cable 3 is passed in order of succession around a cable disc 4, a cable disc 5 and a cable disc 6. The end of the cable is connected with a load 7. The shafts of the cable discs 4 and 5, 8 and 9 respectively are displaceable parallel to themselves. The shafts 8 and 9 are coupled with the plunger rods 10 and 11 respectively forming part of the plunger cylinders 12 and 13 respectively. Each of the plunger cylinders 12 and 13 is provided with an accumulator 14 and 15 respectively. The plunger cylinders may be of the hydraulic type and the accumulators of the hydro-pneumatic type. The conduit between th accumulator 14 and the associated cylinder 12 includes a valve 16. When the plunger reaches the terminal position, the valve 16 closes in order to brake the movement of the plunger.

When the water line 17 is attained, the heaving of the ship may cause slackening of the cable 3 so that the load 18 gets into a more or less floating state and is exposed to the movements of the water. As a result the movements of the load will be quite arbitrary. Since the cable slackens, the force exerted on the shaft 8 of the cable disc 4 decreases so that the plunger 10 is allowed by the force exerted thereon by the hydraulic fluid to slide outwards. This movement continues until the cable is again stretched so that a state of equilibrium is obtained between the force exerted on the plunger and on the shaft 8 by the hydraulic fluid and the force exerted on the shaft 8 by the cable. According as the load is further immersed, the plunger 10 moves gradually further towards its starting position. The pressure in the accumulator 14 is chosen so that, when the load 18 is fully immersed, the plunger 10 is in its terminal position. Thereafter this plunger does no longer contribute to maintaining the cable in the taut state.

The pressure in the accumulator 15 is chosen so that the plunger 11 has in the meantime arrived approximately midway between the terminal positions under the action of the force exerted by the cable on the shaft 9 and of the force exerted by the hydraulic fluid on the plunger. The compensation of the heaving of the ship, when the load 18 is completely beneath the water line, is brought about by the plunger cylinder 13. Since with the variations of the force exerted on the shaft 9 the plunger 11 will oscillate around the central position, it is ensured that the cable remains taut.

What I claim is:

1. A cable system for lowering a load, for example a diving bell, from a vessel between a position above to a position below the water line without allowing the cable to develop slack due to wave motion, which comprises:

a winch and a cable controlled by said winch and adapted to be connected to the load; and slack take-up means engaging said cable between the winch and the load for automatically maintaining the cable taut not only during partial immersion but also after total immersion of the load, said slack take-up means comprising first means movable from a retracted to an extended position to compensate for decrease in load weight on said cable due to movement of the load from a position above the water line to a position of total immersion and second means movable in consonance with said first means during said movement of the load from a position above the water line to a position of total immersion, from a retracted to an intermediate position to compensate for said decrease in load weight in cooperation with said first means and thereafter between said intermediate and said retracted and an extended position to compensate for wave motions imparted to said vessel after said load has been totally immersed and also in the substantial absence of cooperation by said first means.

2. A cable system as defined in claim 1 wherein each said first and second means comprises a cable disc rotatable about a shaft, a plunger cylinder having a plunger rod carrying said shaft, and an accumulator normally urging the plunger rod from retracted to extended position.

3. A cable system as defined in claim 2 wherein the accumulator associated with said first means is subjected to pressure such that the associated plunger is in fully retracted position when the load is above the water and is in its fully extended position when the load is below the water line.

4. A cable system as defined in claim 3 wherein the accumulator associated with said second means is subjected to pressure such that the associated plunger is in fully retracted position when the load is above the water and is in a position substantially midway between its fully retracted and fully extended positions when the load is below the water line.

5. A cable system as defined in claim 4 wherein said plunger cylinders are filled with hydraulic fluid and the accumulators are of the hydro-pneumatic type.

6. A cable system as defined in claim 5 including a conduit communicating the plunger cylinder of said first means with the the accumulator of such first means, and valve means in said conduit for blocking said conduit when the associated plunger cylinder reaches its fully extended position.

7. A cable system as defined in claim 4 including a conduit communicating the plunger cylinder of said first means with accumulator of such first means, and valve means in said conduit for blocking said conduit when the associated plunger cylinder reaches its fully extended position.

8. A cable system as defined in claim 3 wherein said plunger cylinders are filled with hydraulic fluid and the accumulators are of the hydro-pneumatic type.

9. A cable system as defined in claim 8 including a conduit communicating the plunger cylinder of said first means with the accumulator of such first means, and valve means in said conduit when the associated plunger cylinder reaches its fully extended position.

10. A cable system as defined in claim 3 including a conduit communicating the plunger cylinder of said first means with the accumulator of such first means, and valve means in said conduit for blocking said conduit when the associated plunger cylinder reaches its fully extended position.

11. A cable system as defined in claim 2 wherein said plunger cylinders are filled with hydraulic fluid and the accumlators are of the hydro-pneumatic type.

12. A cable system as defined in claim 11 including a conduit communicating the plunger cylinder of said first means with the accumulator of such first means, and valve means in said conduit for blocking said conduit when the associated plunger cylinder reaches its fully extended position.

13. A cable system as defined in claim 2 including a conduit communicating the plunger cylinder of said first means with the accumulator of such first means, and valve means in said conduit for blocking said conduit when the associated plunger cylinder reaches its fully extended position.

* * * * *